United States Patent [19]

Nelson

[11] Patent Number: 4,744,488

[45] Date of Patent: May 17, 1988

[54] METHOD AND DEVICE FOR MANUFACTURING A FOAM INSULATED WATER HEATER, AND A FOAM INSULATED WATER HEATER CONSTRUCTION

[76] Inventor: Thomas E. Nelson, 11102 Ridge Rd., Anchorage, Ky. 40223

[21] Appl. No.: 904,206

[22] Filed: Sep. 8, 1986

[51] Int. Cl.[4] ..... B65D 25/36; B65D 90/06; B65D 90/10

[52] U.S. Cl. ..... 220/444; 220/445; 220/448; 220/465

[58] Field of Search ..... 220/435, 437, 444, 445, 220/448, 465, 466, 467

[56] References Cited

U.S. PATENT DOCUMENTS

| | | | |
|---|---|---|---|
| 3,107,498 | 10/1963 | Messer | 220/465 |
| 3,230,726 | 1/1966 | Bernen | 220/465 |
| 3,598,275 | 8/1971 | Francois | 220/444 |
| 3,623,629 | 11/1971 | Hendershot | 220/465 |
| 4,687,118 | 8/1987 | Clark | 220/444 |

FOREIGN PATENT DOCUMENTS

| | | | |
|---|---|---|---|
| 203337 | 11/1983 | Japan | 220/444 |

*Primary Examiner*—George E. Lowrance
*Attorney, Agent, or Firm*—Jon C. Winger

[57] ABSTRACT

A water heater construction including an inner water tank surrounded in spaced apart relationship by an outer shell. A control apparatus, such as a thermostat, is located at the exterior wall surface of the inner tank, and the outer shell has an aperture in alignment with the control apparatus. A collar is located around the control apparatus and is compressed between the inner tank and outer shell. The space between the inner tank and outer shell is filled with a foamed insulation material. The water heater is manufactured by first positioning the collar about the periphery of the control device in abutment with the exterior surface of the inner tank. Next the outer shell is positioned over the inner tank with a concentric space between the inner tank and outer shell, and with the interior surface of the outer shell in abutment with the collar compressing the collar between the inner tank and outer shell. Expandable foam is disposed in the space between the tank and shell and allowed to foam in situ. The collar is fabricated of a thermal insulating material and has a centrally located opening with a peripheral configuration matching that of the control apparatus and sized to fit therearound.

22 Claims, 2 Drawing Sheets

METHOD AND DEVICE FOR MANUFACTURING A FOAM INSULATED WATER HEATER, AND A FOAM INSULATED WATER HEATER CONSTRUCTION

BACKGROUND OF THE INVENTION

The present invention relates to water heaters and more particularly to a foam insulated water heater construction, a method of manufacturing a foam insulated water heater, and a collar device for use in a foam insulated water heater construction to prevent foaming insulating material from covering heater controls.

Typically, water heaters are formed of an inner water tank with an outer shell located over the inner tank with a space therebetween. The space between the inner tank and outer shell is filled with a thermal insulation. For many years fiber glass has been used as the insulation material between the inner tank and outer shell. More recently, a foam such as urethane, has been used as the thermal insulation material in place of fiber glass between the inner tank and outer shell. Typically, the foamable material is injected into the space between the inner tank and outer shell, and is allowed to foam in situ.

A problem exists, however, in restraining the foam in desired locations within the space. For example, electric and gas water heaters have heating control apparatus located at and attached to the exterior surface of the inner water tank. It is, of course, important that these controls not be covered with insulating foam.

Various methods and devices have been used in an attempt to prevent the foam urethane from covering the heating control apparatus. For example, one method of attempting to prevent the urethane foam from covering the control device is to pack the area round the control device with fiber glass to function as a barrier to the urethane foam during the foaming process. A drawback with this method is that the foaming urethane material exerts a sufficiently great force on the fiber glass pack as to dislodge it.

One known attempt to prevent the dislodgement of the fiber glass pack is to fabricate the fiber glass pack much thicker than the width of the space between the inner tank and outer shell so that the fiber glass pack will be highly compressed between the inner tank and outer shell when the shell is located concentrically over the tank to resist the forces generated by the expanding foam insulating material. However, this scheme makes the assembly of the outer shell over the inner tank difficult and slow, and results in inconsistent quality of the finished water heater. It is very difficult to hold the uncompressed fiber glass pack in place on the inner tank while the outer shell is installed over the inner tank because either the thickness of the uncompressed fiber glass pack must, somehow, be compressed to conform to the width of the space between the tank and shell before the shell is placed over the tank, or the shell must be initially located off-center over the tank providing a wide space in the vicinity of the uncompressed pack and then moved to a concentric relationship. This procedure increases the chances of displacing the fiber glass pack during assembly of the shell over the tank and the chances of producing a water heater with the shell off-center relative to the tank.

Even in the event that the fiber glass pack is not dislodged to the extent that the foam by-passes it covering the control device, the fiber glass does not have as great a heat insulating valve as the rigid urethane foam.

Therefore, there is a greater heat loss in the area of fiber glass than through the surrounding layer of foam.

U.S. Pat. No. 4,372,028 issued on Feb. 8, 1983 discloses another means for preventing insulating foam from covering the control device of an electric device of an electric water heater. In this patent, an elongated flexible bag having an open top and sealed side and bottom edges has an opening through its side walls. The elongated bag is positioned vertically on the inner tank with the opening through the bag side walls positioned over the control device, and is affixed to the wall of the tank. The outer shell is positioned over the inner tank and the elongated bag is injected with expandable foam. After the foam has been allowed to expand in the elongated bag, the rest of the space between the inner tank and outer shell is filled with expandable foam.

U.S. Pat. No. 4,447,377 issued on May 8, 1977 discloses two other ways for preventing insulating foam from covering the control device of an electric water heater. In one embodiment, an elongated preformed member of fiber glass or premolded polyurethane foam is used to insulate around the control devices. The preformed member is as long as the inner tank is tall and has cut-out openings therethrough for receiving the control devices. The elongated preformed member is placed vertically on the exterior wall surface of the inner tank with the control device projecting through the cut out-openings. Next, a plastic envelope is installed to encompass the outer periphery of the inner tank except for that area covered by the elongated preformed member. The outer shell is then installed over the inner tank, and the envelope is injected with an expandable foam. The envelope is necessary to prevent the expanding foam material from forcing its way into the interfaces between the preformed member and the inner tank and outer shell. It should be noted that it is the plastic envelope and not the elongated preformed member which prevents the foam from covering the control device. In another embodiment, a plastic envelope is installed to completely encompass the outer periphery of the inner water tank. The envelope is provided with welded cut-outs which overlay the control devices. The outer shell is then installed over the inner tank, and the envelope is injected with an expandable foam.

U.S. Pat. No. 4,477,399 issued on Oct. 16, 1984 shows yet another way preventing insulating foam from covering the control device of an electric water heater. An inflatable toroidal tube is inserted in the space between the inner tank and outer shell surrounding the control device, and it is inflated with air. Next, the space between the inner tank and outer shell is injected with expandable foam material. After the foam material has expanded, the tube is deflated and removed.

SUMMARY OF THE INVENTION

It is an object of the present invention to provide a water heater construction and method of manufacturing the same which is straightforward relatively easy to assemble.

It is another object of the invention to provide an insulation component of the water heater for insulating about a control device of the water heater which has insulating properties that more closely matches the insulating properties of the foamed insulation used to insulate the walls of the water heater than does fiber glass.

It is a further object of the invention to provide an insulation component of the class described above which blocks the flow of foam insulating material therepast during the assembly process.

It is yet another object of the invention to provide a water heater construction which is uniformly insulated about its perimeter, in that there is an envelope of foam insulation about the perimeter even though there may be a variation in the thickness of the foam.

BRIEF DESCRIPTION OF THE DRAWINGS

The features and benefits of the present invention will become evident upon reference to the following description in conjunction with the accompanying drawings in which like numerals refer to like parts throughout the several views and wherein.

DETAILED DESCRIPTION OF THE PREFERRED EMBODIMENT

Figure 1:
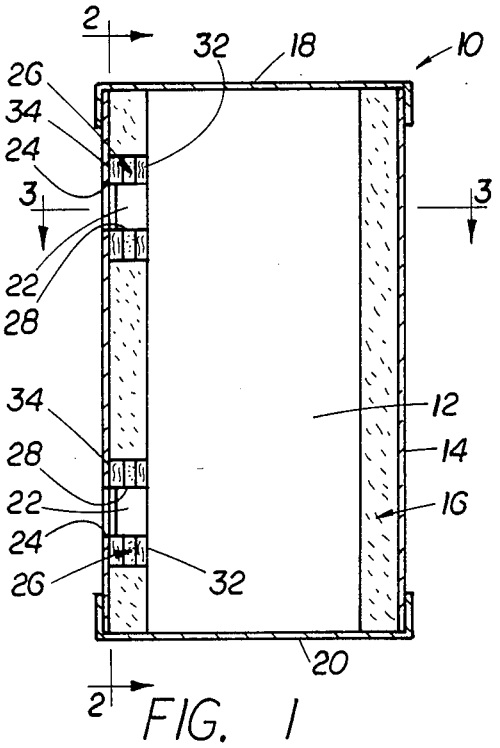
FIG. 1 is a partially cross-sectioned side view of a water heater construction of the present invention.
Figure 3:
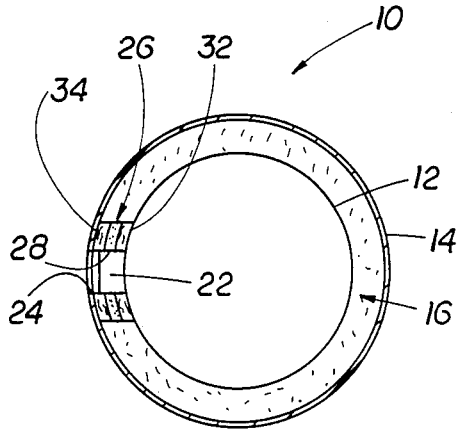
Figure 2:
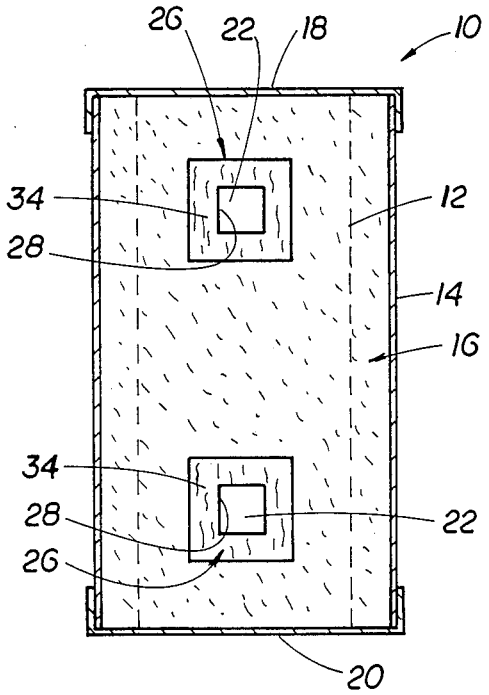
FIG. 2 is a view of the water heater construction as seen in the direction of arrows 2—2 in FIG. 1; and, FIG. 3 is a transverse cross-sectional view of the water heater construction of FIG. 1 as seen in the direction of arrows 3—3 in FIG. 1, but with the insulation of the water tank removed.

FIGS. 1, 2 and 3 illustrtate a water heater, generally denoted as the numeral 10. The water heater 10 includes an inner water containing tank 12 and an outer shell 14 located concentrically over the inner tank 12 with a uniformly wide annular space 16 therebetween. The top of the water heater 10 is closed by a top wall or cap 18 and the bottom is closed by a bottom wall or base 20. The water heater 10 also includes a control apparatus 22 at the exterior wall surface of the inner tank 12. The control apparatus 22 includes, for example, heating elements which project into the inner tank 12 to heat the water contained therein, and thermostatic controls for adjusting the heat generated by the heating elements. Usually, two such control apparatus are utilized at different elevations of the inner tank 12. Access to the control apparatus 22 from the exterior of the water heater 10 is provided for by access appertures 24 formed through the side wall of the outer shell 14 in alignment with the control apparatus 22. Thusly, the control apparatus 22 is exposed to the exterior of the water heater 10.

Figure 4:
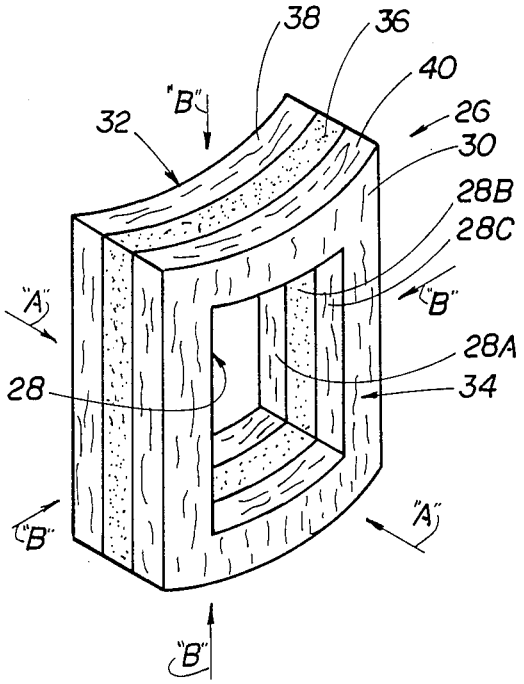
FIG. 4 is a perspective view of one embodiment of a collar device of the present invention.

With continued reference to FIGS. 1, 2 and 3, and additional reference to FIG. 4, there is shown an insulating collar device, generally denoted as the numeral 26, of the present invention. The collar device 26 includes a centrally located opening 28. The peripheral configuration of the collar opening 28 matches the peripheral configuration of the control apparatus 22 and is sized to receive and fit closely around the perimeter of the control apparatus 22. In the embodiment of FIG. 3, the collar opening 28 through the collar device 26 receives the perimeter of the control apparatus 22 with at least a slip fit and, more particularly, a press fit. The outer perimeter of the collar 26 is larger than the perimeter of the control access aperture 24 formed through the wall of the outer shell 14. Preferably, the collar material 30 surrounding the collar opening 28 is of uniform width around the collar opening 28. The collar device 26 includes a back wall surface 32 which will be in abutment with the outer wall surface of the inner tank 12 and a front wall surface 34 which will be in abutment with the interior wall surface of the outer shell 14 of the water heater. The thickness of the collar 26 measured between the back surface 32 and front surface 34, when in the relaxed condition before assembly of the inner tank 12 and outer sleeve 14, is greater than the width of the space 16 between the inner tank 12 and outer shell 14 of the water heater 10. The collar device 26 is fabricated of laminates of diverse materials having different coefficients of compressibility in the direction perpendicular to the back surface and front surface 34 of the collar device 26. The laminated construction preferably comprises three layers of material. The intermediate layer 36 is sandwiched between two outer layers 38 and 40. The two outer layers 38 and 40 can be either of different or the same material as each other, and the intermediate layer 36 is of a different material from either of the two outer layers 38 and 40. The material of the outer two layers 38 and 40 are of a softer, more easily compressible, and more flexible material than is the intermediate layer 36. The intermediate layer 36 is fabricated of a material which is rigid relative to the outer layers and has a greater coefficient of compressibility than does the material of either one of the outer layers 38 and 40 between or perpendicular to the back surface 32 and front surface 34 of the collar device 26 as indicated by the vector arrows "A" in FIG. 4. In addition, the material of the intermediate layer 36 has a greater coefficient of compressibility in a direction laterally of the back surface 32 and front surface 34 of the collar 26, as indicated by the vector arrows "B" in FIG. 3, than it does in the direction between or perpendicular to back surface 32 and front surface 34 (vector arrows "A") of the collar device 26. Examples of materials from which the outer layers 38 and 40 can be fabricated include fiber glass, flexible urethane foam and flexible polyethylene foam. Examples of materials from which the intermediate layer 36 can be fabricated include thermo plastic, wood such as chip board, rigid urethane foam and rigid polyethylene foam. The outer layers 38 and 40 are bonded to the intermediate layer 36. This can be accomplished by, for example, molding the intermediate layer 36 to the outer layers 38 and 40, or adhesively bonding the outer layers 38 and 40 to opposite sides of the intermediate layer 36.

The central opening 28 of the collar 26 is defined by registered opening 28A in outer layer 38, opening 28B in intermediate layer 36 and opening 28C in outer layer 40.

Figure 5:
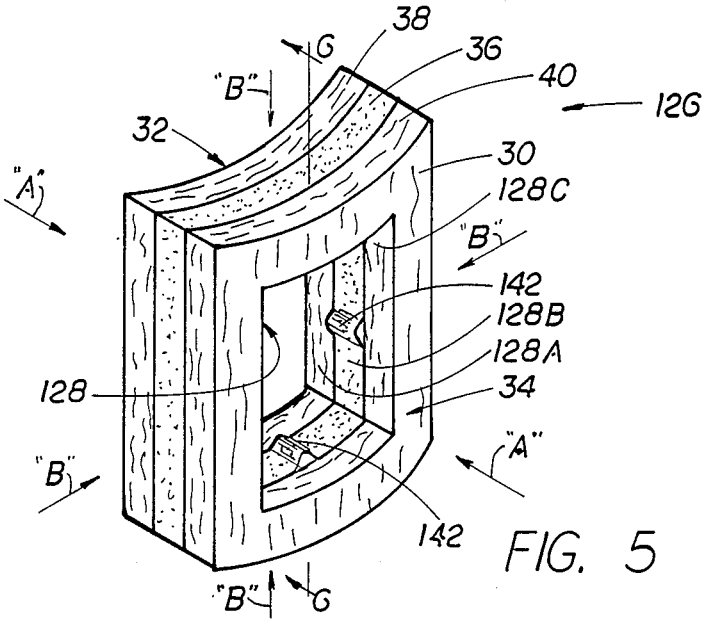
FIG. 5 is a perspective view of another embodiment of a collar device of the present invention.
Figure 6:
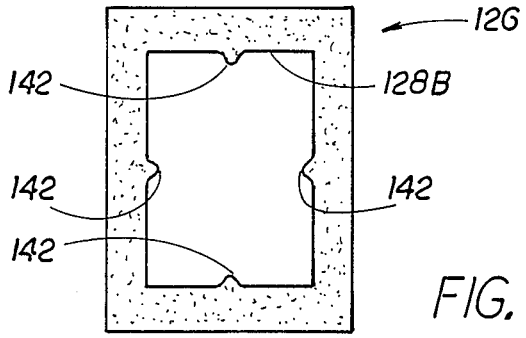
FIG. 6 is a front view of a component of the collar device of FIG. 5.

With reference to FIG. 5, there is shown a collar device, generally denoted as the numeral 126, which is essentially identical to the collar device 26 except for one feature. In the collar device 126 the collar opening 28 is larger than the periphery of the control apparatus 22 to receive and fit loosely around the perimeter of the control apparatus 22 with a clearance therebetween. With additional reference to FIG. 6, which is a front view of the intermediate layer 36 of the collar device 126, a plurality of shim ribs 142 are integrally formed with the margin of the collar opening 28B formed through the intermediate layer 36 of the collar device 126. The shim ribs 142 extend into the collar opening 28B by a distance about equal to the clearance between the periphery of the control apparatus 22 and the margin of the collar opening 28B.

Figure 7:
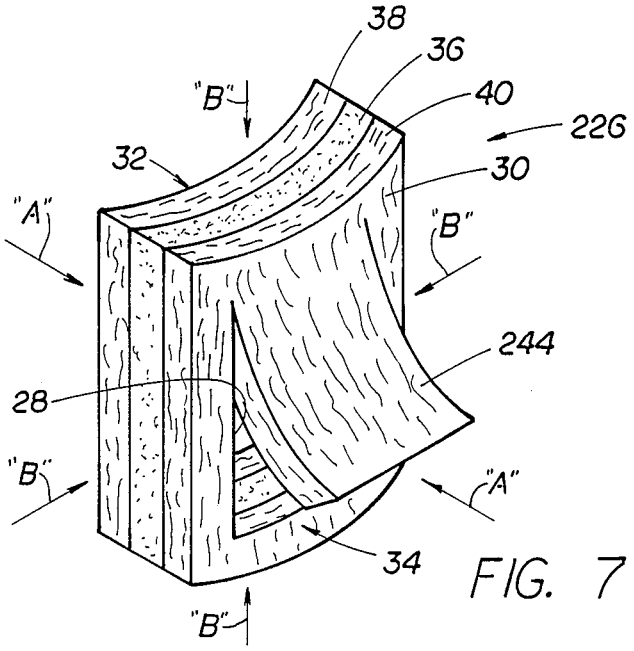
FIG. 7 is a perspective view of yet another embodiment of a collar device of the present invention.

Now with reference to FIG. 7, there is shown another embodiment of a collar device, generally denoted as the numeral 226, which is essentially identical to the collar device 26 and 126, but with the additional feature of a flap 244 which removably covers the opening 28C through the outer layer 40. Toward this objective, the opening 28C is formed by three slits through the material of the outer layer 40 forming the flap 244 integrally attached to the outer layer 40 along the top side of the opening 28C. The flap 244 protects the control apparatus 22, and deminishes heat loss through access apertures 24 in the outer shell 14.

It should be noted that the collar device 26, 126, 226 is arcuately shaped such that the back surface 32 is concave to generally conform the exterior surface configuration of the inner tank 12, and the front surface 34 is convex to generally conform to the interior surface configuration of the outer shell 14. Water heaters are manufactured in various sizes. Smaller water heaters have, for example, a 12 inch diameter inner tank 12, a 16 inch diameter outer shell 14 with a concentric space 16 of 2 inches therebetween. Larger water heaters have, for example, a 23 inch diameter inner tank 12, a 27 inch diameter outer shell 14 with a concentric space 16 of 2 inches therebetween. The advantage of the collar device 26, 126, 226 having the three layer construction is that one size collar device will fit most water heaters. The outer layer 38 of flexible material is compressed between the exterior surface of the inner water heater tank 12 and the rigid intermediate collar layer 36. Similarly, the other outer layer 40 of flexible material is compressed between the interior surface of the outer shell 14 and the rigid intermediate collar layer 36. The intermediate layer 36 can be formed with a nominal arc, and the variations in the arc sizes of the inner tank 12 and outer shell 14 of various sized water heaters will be taken up or compensated for by the flexible material of the two outer layers 38 and 40 of the collar device which will compress to conform the arc of the tank and shell, respectively.

To assemble the water heater construction 10, the collar device 26 is first positioned about the perimeter of the control apparatus 22 with the control apparatus 22 projecting into the collar opening 28, and with the back surface 32 of the collar device 26 in abutment with the exterior wall surface of the inner tank 12. Next, the outer shell 14 is positioned over the inner tank 12 with a uniform space between the inner tank 12 and outer shell 14, and with the interior wall surface of the outer shell 14 in abutment with the front surface 34 of the collar device 26. Thus, the collar device 26 is compressed between the exterior wall surface of the inner tank 12 and the interior wall surface of the outer shell 14.

With the base 20 in position closing the bottom of the water tank 10 in place, expandable foam is injected into the space 16 between the inner tank 12 and outer shell 14. The expandable foam is allowed to expand in situ filling the space 16. When the expanding foam contacts the collar device 26 the material of the collar device 26 functions to block the expanding foam material, thus, preventing the foam from contacting and covering the control apparatus 22. The compression of the collar device 26 between the wall of the inner tank 12 and outer shell 14 produces a sealing fit between the back surface 32 of the collar device 26 and the exterior wall of the inner tank 12 and between the front surface 34 of the collar device 26 and the interior wall surface of the outer shell 14. In addition, the material of the outer layer 38 is compressesd between the exterior wall surface of the inner tank 12 and the intermediate layer 36 of the collar device 26, and the material of the outer layer 40 is compressed between the interior surface of the outer shell 14 and the intermediate layer 36 of the collar device 26. The compressed material of the outer layers 38 and 40 of the collar device 26 functions to physically block penetration of the foaming material. Further, it is speculated that when the outer layers 38 and 40 are fabricated of fiber glass, the compressed fibers stop the foaming action of the expanding material possible by penetrating and breaking up the gas bubbles in the expanding material.

In summary, the outer layers 38 and 40 have the following four basic functions:

1. compress to create seal between interface of outer layers and wall surfaces of inner tank and outer shell.
2. by virtue of compressive nature of outer layers, one size collar will fit a number of different size water heaters.
3. in instances wherein the outer layers are fabricated of fiber glass, serve as a deterent to foam leakage by mechanical interference with foaming material.
4. serve as a thermal insulating material.

In summary, the intermediate layer 36 has the following three basic functions:

1. hold collar in position around control device during the manufacturing process.
2. rigid property allows the intermediate layer to function as a load bearing member resisting forces created by the foaming material preventing dislodgement of the collar or deformation of the geometry of the collar which could result in foam leakage.
3. serve as a thermo insulator providing the inner water tank with an encompassing envelope.

The foregoing description is given primarily for clearness of understanding and no unnecessary limitations are to be understood therefrom for modifications will become obvious to those skilled in the art upon reading the disclosure and may be made without departing from the spirit of the invention or scope of the appended claims.

What is claimed is:

1. An insulating device for use in insulating water heaters of the type having an inner tank and an outer shell spaced from the inner tank defining an annular space therebetween, and at least one control apparatus at the exterior wall surface of the inner tank extending into the space between the inner tank and outer shell, the outer shell having an aperture through the shell wall in alignment with the control apparatus to expose the control apparatus to the exterior of the water heater providing access to the control apparatus, the insulating device comprising:

a collar to be received in the space between the inner tank and outer shell having a back surface for fitting in abutment against the exterior wall surface of the inner tank and a front surface for fitting in abutment against the interior wall surface of the outer shell, the thickness of the collar measured between the back surface and front surface being greater than the width of the space between the tank wall and shell wall, a generally centrally located opening therethrough from the collar back surface to the collar front surface, the peripheral configuration of the collar opening matching the peripheral configuration of the control apparatus and sized to fit closely around the perimeter of the control apparatus, the outer perimeter of the collar being larger than the perimeter of the aperture through the outer shell, the collar being fabricated of at least three laminates of diverse thermal insulating materials, the intermediate layer having a greater coefficient of compression in the direction between the collar back surface and collar front surface than either one of the outer layers such that when the collar is installed about the control apparatus between the inner tank and outer shell of the water heater the outer layer of the laminated collar in contact with the exterior wall surface of the inner tank is compressed between the tank wall and intermediate collar layer and the outer layer of the laminated collar in contact with the interior wall surface of the outer shell is compressed between the shell wall and intermediate collar layer.

2. The insulating device of claim 1, wherein the intermediate layer of the collar has a greater coefficient of compression in the direction laterally of the collar back surface and collar front surface than either one of the outer collar layers.

3. The insulating device of claim 1, wherein the laminated collar comprises three layers of material, the intermediate layer sandwiched between the two outer layers being of a different material than the outer layers.

4. The insulating device of claim 3, wherein the intermediate layer of the collar is fabricated of a rigid material and the outer layers of the collar are fabricated of a flexible material.

5. The insulating device of claim 3, wherein the intermediate layer of the collar is arcuately shaped.

6. The insulating device of claim 3, wherein the intermediate layer of the collar is fabricated of a rigid foam material.

7. The insulating device of claim 4, wherein the intermediate layer of the collar is fabricated of a thermo plastic material.

8. The insulating device of claim 4, wherein the intermediate layer of the collar is fabricated of wood.

9. The insulating device of claim 3, wherein the two ouoter layers of the collar are of different materials than each other.

10. The insulating device of claim 9, wherein one outer layer is fabricated of a flexible foam.

11. The insulating device of claim 10, wherein the other outer layer is fabricated of fiber glass.

12. The insulating device of claim 3, wherein the two outer layers of the collar are of the same material as each other.

13. The insulating device of claim 12, wherein the two outer layers of the collar are fabricated of a flexible foam.

14. The insulating device of claim 12, wherein each of the outer layers of the collar are fabricated of fiber glass.

15. The insulating device of claim 1, wherein the collar opening is sized to fit around the outer periphery of the control apparatus with a press fit.

16. The insulating device of claim 1, wherein:

the collar opening is sized to fit around the outer periphery of the control apparatus with a clearance therebetween; and, a plurality of shim ribs extend from the margin of the collar opening into the collar opening by a distance at least equal to the clearance between the periphery of the control apparatus and margin of the collar opening.

17. The insulating device of claim 16, wherein the shim ribs are integral with the margin of the collar opening through the intermediate collar layer.

18. The insulating device of claim 1, wherein the back surface of the collar device is concavely arcuate in shape and the front surface of the collar device is convexly arcuate in shape.

19. The insulating device of claim 3, wherein the layers of the laminated collar are molded together.

20. The insulating device of claim 3, wherein the layers of the laminated collar are adhesively attached together.

21. A water heater construction comprising:

an inner tank;

an outer shell spaced from and encompassing the inner tank defining an annular space therebetween;

at least one control apparatus at the exterior wall surface of the inner tank extending into the space between the inner tank and outer shell;

the outer shell having an aperture therethrough in alignment with the control apparatus to expose the control apparatus to the exterior of the water heater providing access to the control apparatus;

a collar device received in the space between the inner tank and outer shell, the collar device having a back surface in abutment with the exterior wall surface of the inner tank and a front surface in abutment with the interior surface of the outer shell, the thickness of the collar between the back surface and front surface being greater than the width of the space between the tank wall and shell wall, a generally centrally located opening through the collar from the collar back surface to the collar front surface, the peripheral configuration of the collar opening matching the peripheral configuration of the control apparatus and sized to fit around the perimeter of the control apparatus with a close fit, the outer perimeter of the collar being larger than the perimeter of the aperture through the outer shell, the collar being fabricated of at least three laminates of diverse thermal insulating materials, the intermediate layer having a greater coefficient of compression in the direction between the collar back surface and collar front surface than either one of the outer layers such that the outer layer of the laminated collar in contact with the exterior wall surface of the inner tank is compressed between the tank wall and intermediate collar layer and the outer layer of the laminated collar in contact with the interior wall surface of the outer shell is compressed between the shell wall and intermediate collar layer; and, a foam thermal insulating material filling the space between the inner tank and outer shell.

22. A method of manufacturing a water heater having an inner tank, an outer shell spaced from and encompassing the inner tank defining an annular space therebetween, at least one control apparatus at the exterior wall surface of the inner tank extending into the space between the inner and outer shell, the outer shell having an aperture therethrough in alignment with the control apparatus to expose the control apparatus to the exterior of the water heater providing access to the control apparatus comprising the steps of:

positioning a collar of at least three laminated layers of thermal insulating material about the perimeter of the control apparatus with one of the outer laminated collar layers in abutment with the exterior wall surface of the inner tank;

positioning the outer shell concentrically over the inner tank with an annular space therebetween and the interior wall surface of the outer shell in abutment with the other one of the laminated collar layers compressing the one outer layer in abutment with the tank wall between the tank wall and intermediate laminated collar layer and compressing the other one of the outer layers in abutment with the shell wall between the shell wall and intermediate laminated collar layer;

disposing an expandable foam in the space between the inner tank and outer shell; and, allowing the foam to expand in situ.

* * * * *